US011910967B2

(12) United States Patent
Petersen

(10) Patent No.: US 11,910,967 B2
(45) Date of Patent: Feb. 27, 2024

(54) TOILET SEAT LIFTING AND LOWERING APPARATUS

(71) Applicant: Damien Petersen, Warsaw, IN (US)

(72) Inventor: Damien Petersen, Warsaw, IN (US)

( * ) Notice: Subject to any disclaimer, the term of this patent is extended or adjusted under 35 U.S.C. 154(b) by 0 days.

(21) Appl. No.: 17/503,432

(22) Filed: Oct. 18, 2021

(65) Prior Publication Data

US 2022/0117448 A1 Apr. 21, 2022

Related U.S. Application Data

(60) Provisional application No. 63/093,488, filed on Oct. 19, 2020.

(51) Int. Cl.
*A47K 13/10* (2006.01)

(52) U.S. Cl.
CPC ..... *A47K 13/10* (2013.01)

(58) Field of Classification Search
CPC ..... A47K 13/10
USPC ..... 4/246.1
See application file for complete search history.

(56) References Cited

U.S. PATENT DOCUMENTS 2,410,854 A * 11/1946 Zulkoski ..... A47K 13/10 74/490.11
3,504,385 A * 4/1970 Marshall ..... E03D 5/08 4/246.5
5,103,506 A * 4/1992 Munford ..... A47K 13/10 4/246.4
6,151,723 A * 11/2000 MacAllister ..... A47K 13/10 4/246.1
6,470,503 B1 * 10/2002 Holmes ..... A47K 13/10 4/246.1
2004/0172744 A1 * 9/2004 Mills ..... A47K 13/10 4/246.1
2008/0307572 A1 * 12/2008 Leutschaft ..... A47K 13/10 4/246.1
2009/0100581 A1 * 4/2009 Mixon ..... A47K 13/10 4/242.1

* cited by examiner

*Primary Examiner* — Christine J Skubinna
(74) *Attorney, Agent, or Firm* — Brennan, Manna & Diamond, LLC

(57) ABSTRACT

An apparatus configured to lift and lower a toilet seat on a toilet without the need to touch the toilet seat. The toilet seat lifting and lowering apparatus attaches directly to the bathroom floor and the toilet seat. A foot lever is pivotally attached to a base component that is securable to the floor next to the toilet. The foot lever is pivotally connected to a lifting lever that extends upward toward the toilet seat. A toilet seat attachment component is pivotally attached to a distal end of the lifting lever extending perpendicularly where it engages the toilet seat. The user steps on a foot pedal of the foot lever pushing up the lifting lever to raise the toilet seat. To lower the toilet seat, the user removed their foot from the foot pedal allowing the lifting lever to return the toilet seat to the down position.

6 Claims, 9 Drawing Sheets

TOILET SEAT LIFTING AND LOWERING APPARATUS

CROSS-REFERENCE TO RELATED APPLICATION

The present application claims priority to, and the benefit of, U.S. Provisional Application No. 63/093,488, which was filed on Oct. 19, 2020 and is incorporated herein by reference in its entirety.

FIELD OF THE INVENTION

The present invention generally relates to the field of improving toilet seat hygiene, and more specifically to an apparatus configured to open and close a toilet seat without the need to use one's hands. Accordingly, the present specification makes specific reference thereto. However, it is to be appreciated that aspects of the present invention are also equally amenable to other like applications, devices, and methods of manufacture.

BACKGROUND

A toilet seat is a hinged element generally shaped as a round or oval open seat. The seat may be combined with a lid, which are attached to the bowl of a toilet. The seat is used in a sitting position. The toilet seat is simply the seat itself. Toilet seats may be contoured for the user to sit on. The toilet lid generally covers the opening in the toilet bowl when it is not in use or during a flush when the user puts it down.

As mentioned, toilet seats often have a lid which is frequently left open. This allows the toilet to be used without the need to touch any part of it. However, the combined toilet seat and lid may be alternatively kept in a closed position when a toilet is not in use. This requires the user to raise at least the lid and possibly the toilet seat as well prior to use. The lid is often closed to prevent anything from falling in, to reduce odors, or for aesthetic purposes when the toilet is not in use The lid may also be closed during a flush for hygienic purposes.

Depending on the sex of the user and type of use, urination or defecation, the seat itself may be left in either an up or down position. Whether the seat and lid should be placed in the closed position after use depends on user preference and convenience. Men frequently leave the toilet seat up is more efficient for men which is convenient for urination. However, women require the toilet seat down to use the toilet for any purpose. Everyone requires the toilet seat in the down position for defecation.

Men also commonly lift up a toilet seat to urinate to prevent urine droplets from getting on the seat. Leaving urine on the seat is unsanitary and forcing others to clean it is rude and disgusting. Touching a public toilet seat is unhygienic and can lead to serious illness. No one wants to actually touch the toilet seat when having to lift it up to urinate. This is especially true for germaphobes or those individuals with back issues that can't bend down easily.

Accordingly, there is a great need for a way to lift or lower a toilet seat up without ever having to bend down. There is also a need for a way for to lift or lower a toilet seat up without ever having to touch the seat. Similarly, there is a need for a way to limit the risk of contracting germs, viruses, and bacteria while using a toilet. Further, there is a need for a way to prevent urine from leaking onto a toilet seat by ensuring that the toilet seat is fully elevated prior to going to the bathroom.

In this manner, the improved commemorative system of the present invention accomplishes all of the forgoing objectives, thereby providing an easy solution for lifting and lowering a toilet seat up without physically ever having to touch the seat. A primary feature of the present invention is a foot operated apparatus which raises and lowers a toilet seat up without ever having to bend over. The present invention allows the user to mitigate the risk of contracting germs, viruses, and bacteria while using a toilet caused by physical contact. Finally, the improved toilet seat lifting and lowering apparatus of the present invention is capable of improving overall bathroom hygiene by preventing urine from leaking onto a toilet seat by ensuring that the toilet seat is fully elevated prior to going to the bathroom.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one embodiment thereof, comprises a toilet seat lifting and lowering apparatus. The toilet seat lifting and lowering apparatus is attachable to a toilet seat of a toilet and configured to raise and lower the toilet seat without a user touching the toilet. The toilet seat lifting and lowering apparatus is securable to the floor adjacent to the toilet.

The toilet seat lifting and lowering apparatus comprises a base component, a foot lever, a lifting lever, and a toilet seat attachment component. The base component is mechanically attachable or mountable to the floor via a plurality of mounting holes with traditional mechanical fasteners. The base component comprises a receiving slot for engaging the foot lever.

The foot lever is pivotally attachable to the base component. The foot lever comprises a receiving slot engaging member configured to engage and mate with the receiving slot to form a hinge joint. The foot lever further comprises a foot pedal and an arm extending out of the foot pedal. The arm terminates in a bracket. When the foot pedal is depressed, the foot lever pivots along the hinge joint raising the arm upward. Conversely, when the foot pedal is released, the foot lever pivots along the hinge joint lowering the arm.

The lifting lever is pivotally attached to and extends upwardly from one end of the foot lever. The lifting lever comprises a primary member. The primary member comprises a proximal end terminating in a pivot connector. The pivot connector is configured to movably engage the bracket of the foot lever arm. The primary member further comprises a distal end. The distal end may comprise a pivot connector for movably engaging the toilet seat attachment component.

The lifting lever may be adjustable in length further comprising an extension member. The extension member telescopes out of the primary member extending outward from the distal end of the primary member. The extension member comprises a plurality of locking positions. The plurality of locking positions are used to fix the lifting lever at different lengths to accommodate different toilet seat heights. The extension member further comprises a distal end. The distal end of the extension member comprises a pivot connector for movably engaging the toilet seat attachment component. The extension member may be a spring piston.

The toilet seat attachment component is pivotally attached to the lifting lever. The toilet seat attachment component extends perpendicularly from the distal end of either the primary member or the extension member of the lifting lever. The toilet seat attachment component comprises a lifting lever connector and a toilet seat bracket. The lifting lever connector comprises a bracket and an arm extending from the bracket. The bracket is configured to movably engage the pivot connector of the distal end of either the primary member or the extension member of the lifting lever. The arm comprises a plurality of attachment holes.

The toilet seat bracket is attachable to the lifting lever connector. The toilet seat bracket comprises a lifting lever attachment portion and a seat engaging member. The lifting lever attachment portion comprises a plurality of attachment holes that mate with the plurality of attachment holes of the arm of the lifting lever connector. The lifting lever attachment portion is then securable to the arm of the lifting lever connector with mechanical fasteners. The seat engaging member is configured to engage the toilet seat.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
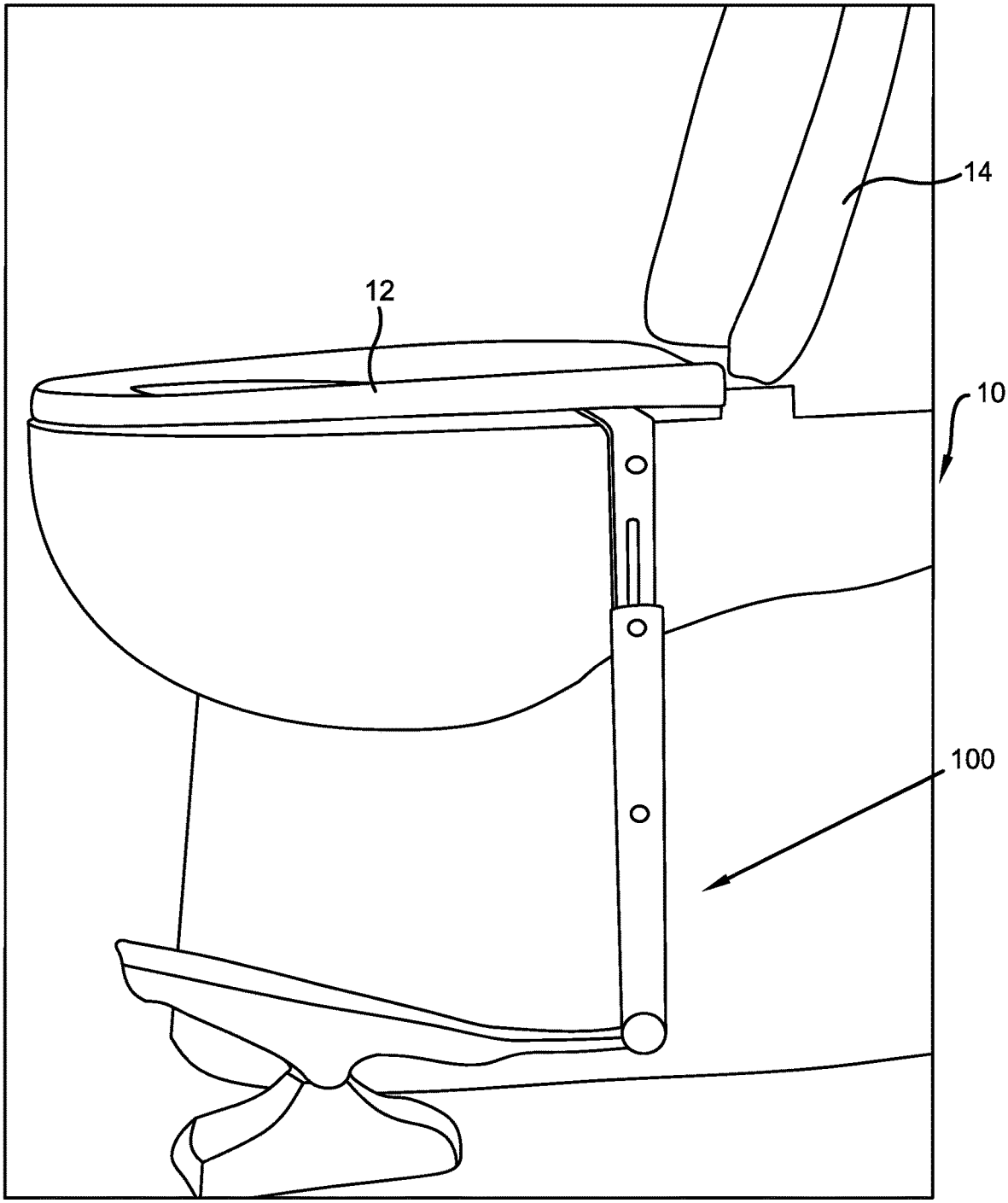
FIG. 1 illustrates a perspective view of one potential embodiment of a toilet seat lifting and lowering apparatus of the present invention attached to a toilet seat in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They do not intend as an exhaustive description of the invention or do not limit the scope of the invention. Additionally, an illustrated embodiment need not have all the aspects or advantages shown. Thus, in other embodiments, any of the features described herein from different embodiments may be combined.

The present invention, in one exemplary embodiment, allows a user to press a pedal down with a foot to raise a toilet seat. Once the pedal raises the seat up, the toilet seat stays in place until you put it back down. To lower the toilet seat, the user lets releases the pedal with their foot thereby allowing the seat to return to a closed position.

The invention features a foot pedal mounted to a lever attached to the floor via a swiveling bracket, allowing users to simply step on the pedal to activate the lifting mechanism. The invention further utilizes a hinge, spring, and arm which work in conjunction to slowly lift and lower the toilet seat when pressure is applied or released from the pedal. This eliminates the need to lift the toilet seat by hand and risk contracting germs, viruses, and bacteria. The invention also prevents urine from leaking onto a seat by ensuring the seat is fully elevated prior to going to the bathroom.

At the other end of the lever, it is attached to another lever with a hinge. The second lever goes up and is attached to the toilet seat. A spring and a strong arm may be attached between the two levers and configured to slowly bring the seat down as the pedal is released. Components of the invention may clip together or be joined with mechanical fasteners. The apparatus may be screwed to the floor and features a clamp that mounts to the toilet seat via a nut and bolt or screws. A heavier duty constructed version may also be mounted to the toilet seat and floor the same way but will include the spring and strong arm which will bolt to the two levers. The system allows users to apply pressure to the pedal for lifting the seat and releasing it for lowering the seat.

Referring initially to the drawings, FIGS. 1-10 illustrate a toilet seat lifting and lowering apparatus 100. As illustrated in FIG. 1, the toilet seat lifting and lowering apparatus 100 is for use with a toilet 10. The toilet 10 comprises a toilet seat 12 and may also further comprises a lid 14. The toilet seat lifting and lowering apparatus 100 is attachable to the toilet seat 12 of the toilet 10 and configured to raise and lower the toilet seat 12 without touching the toilet 10. The toilet seat lifting and lowering apparatus 100 can also be used to raise the lid 14 as well. The toilet seat lifting and lowering apparatus 100 is securable to the floor adjacent to the toilet 10. The toilet seat lifting and lowering apparatus 100 is generally constructed from heavy duty plastics, metal, or similar durable materials.

Figure 2:
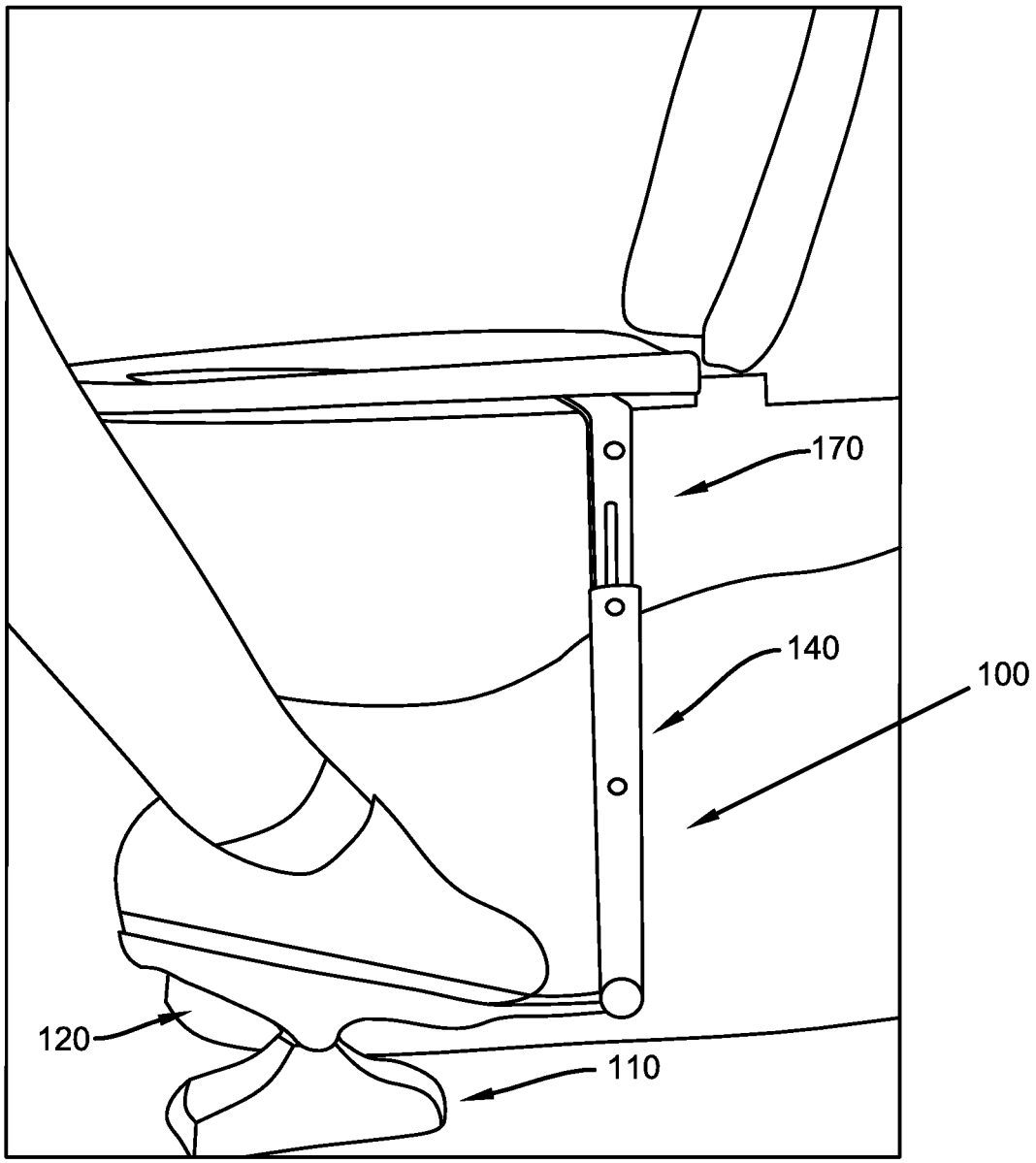
FIG. 2 illustrates a perspective view of a user engaging one potential embodiment of the toilet seat lifting and lowering apparatus of the present invention attached to a toilet seat in a down position in accordance with the disclosed architecture.

As illustrated in FIG. 2, the toilet seat lifting and lowering apparatus 100 comprises a base component 110, a foot lever 120, a lifting lever 140, and a toilet seat attachment component 170. As further illustrated in FIGS. 2-4, the base component 110 is mechanically attachable or mountable to the floor adjacent to the toilet 10. The base component 110 comprises a plurality of mounting holes 114. A bottom 112 of the base component 110 is flat to rest against the floor. Traditional mechanical fasteners are then used to secure the base component 110 via the plurality of mounting holes 114. The base component 110 extends upward terminating in an apex and further comprises a receiving slot 116. The receiving slot 116 is configured to movably engage the foot lever 120 so that the foot lever 120 will seesaw along the pivot point creates by the connection between the receiving slot 116 and the foot lever 120.

Figure 6:
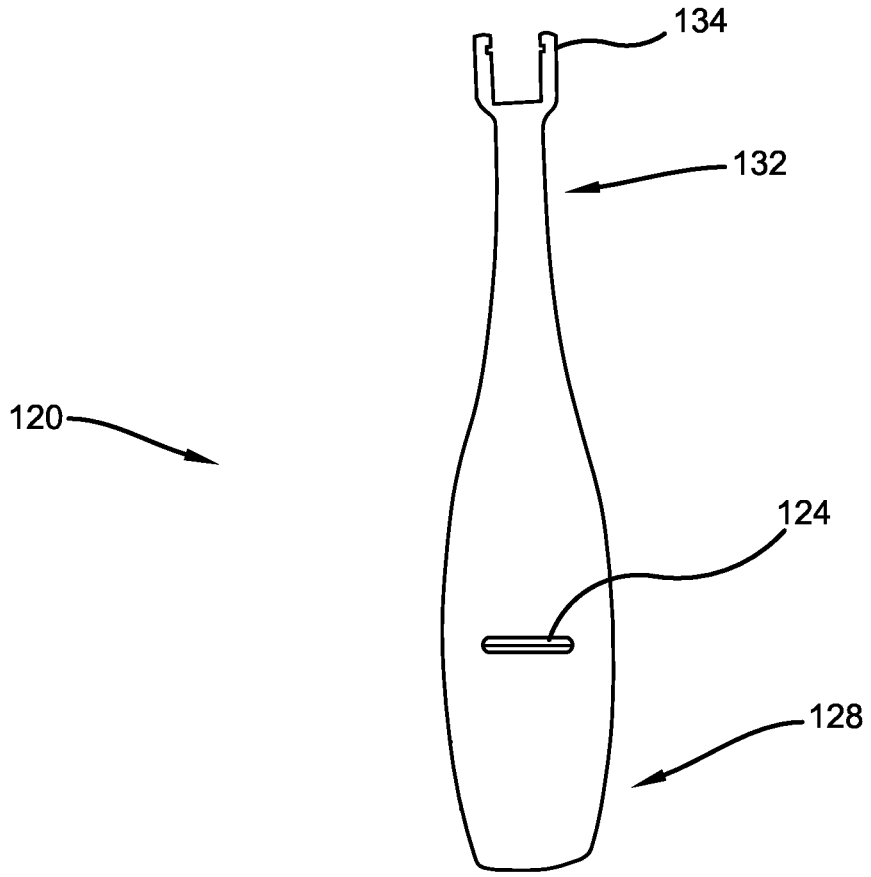
FIG. 6 illustrates an underneath view of one potential embodiment of a foot lever of the toilet seat lifting and lowering apparatus of the present invention in accordance with the disclosed architecture.

The foot lever 120 is pivotally attachable to the base component 110. As illustrated in FIG. 6, the foot lever 120 comprises a receiving slot engaging member 124 located on a bottom side 122 of the foot lever 120. The receiving slot engaging member 124 may be a pin, dowel, rod, or similar pivotal connector configured to engage and mate with the receiving slot 116 of the base component 110 to form a hinge joint. The receiving slot 116 is configured to movably accept and engage the receiving slot engaging member 124 so that the foot lever 120 will seesaw along the pivot point created by the connection between the receiving slot 116 and the receiving slot engaging member 124.

Figure 3:
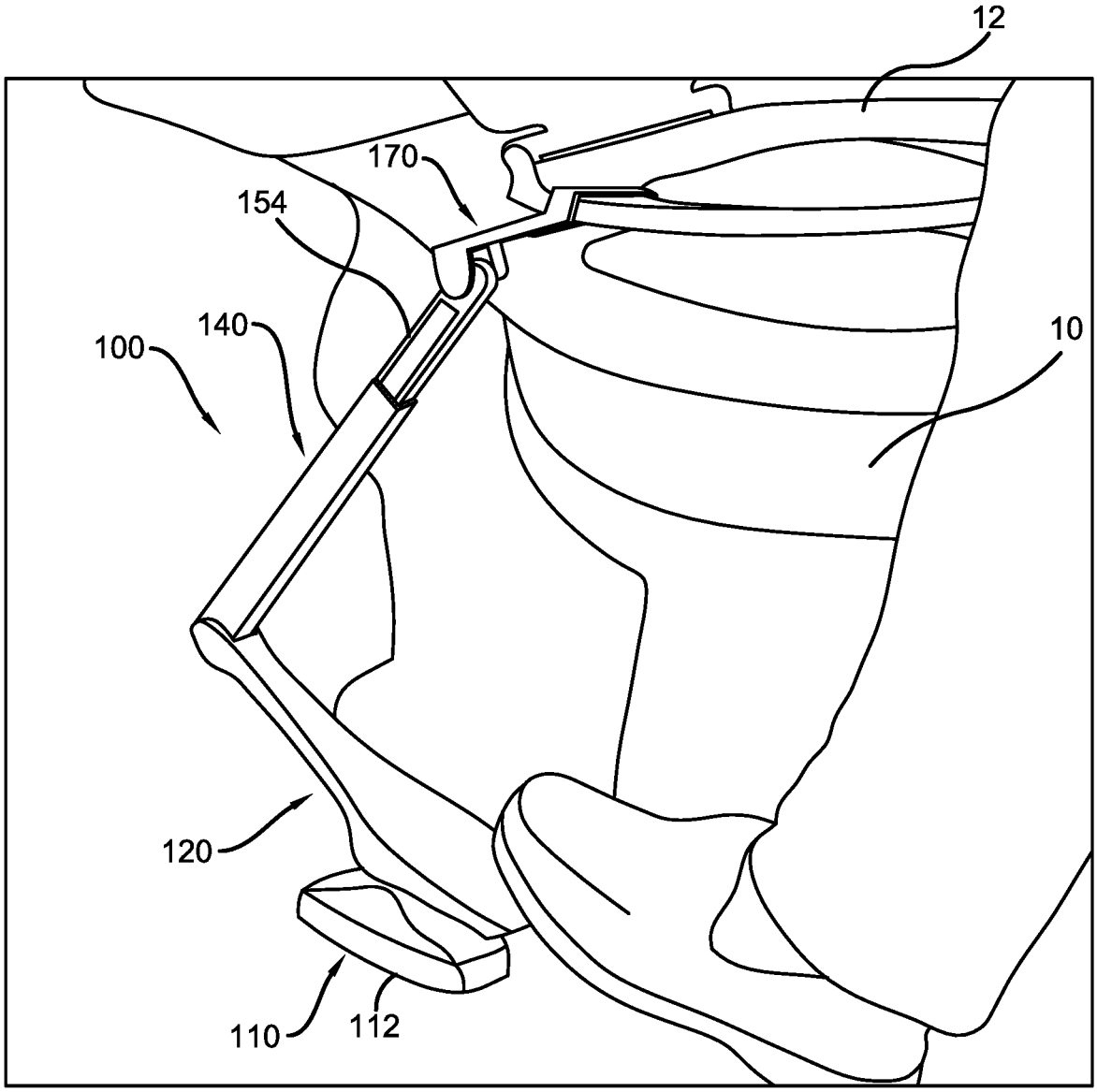
FIG. 3 illustrates a perspective view of the user lifting the toilet seat with one potential embodiment of the toilet seat lifting and lowering apparatus of the present invention attached to a toilet seat in a partially raised position in accordance with the disclosed architecture.

The foot lever 120 further comprises a foot pedal 128 and an arm 132. The arm 132 extends out of the foot pedal 128 at the pivot point created by the connection between the receiving slot 116 and the receiving slot engaging member 124. The arm 132 terminates in a bracket 134. The bracket 134 is generally u-shaped and configured to engage the lifting lever 140. When a top side 126 of the foot pedal 128 is depressed, the foot lever 120 pivots along the hinge joint created by the connection between the receiving slot 116 and the receiving slot engaging member 124 raising the arm 132 upward as illustrated in FIG. 3. Conversely, when the foot pedal 128 is released by the user, the foot lever 120 pivots along the hinge joint lowering the arm 132 as illustrated in FIG. 2.

Figure 4:
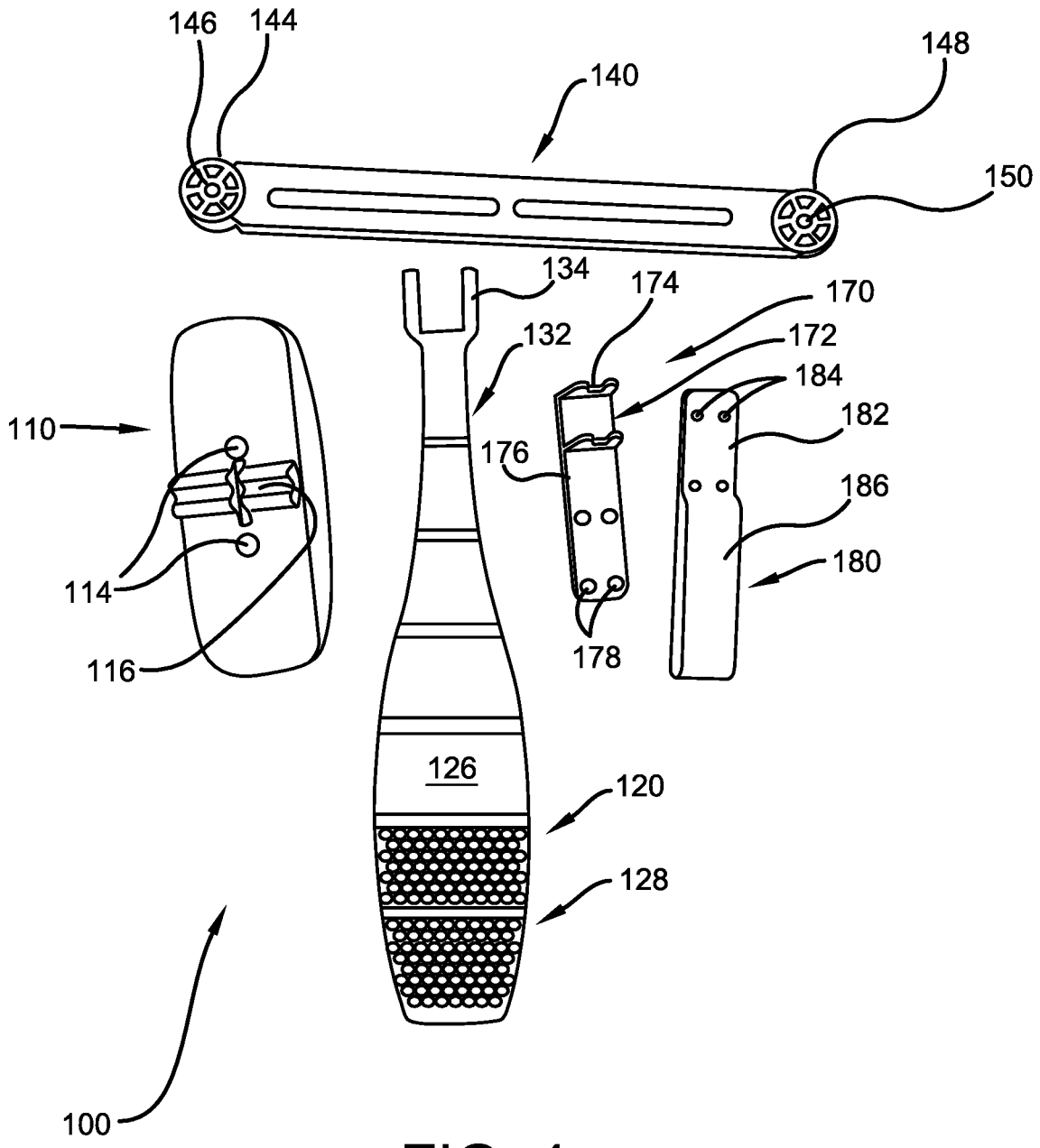
FIG. 4 illustrates a perspective view of one potential embodiment of the toilet seat lifting and lowering apparatus of the present invention disassembled in accordance with the disclosed architecture.
Figure 5:
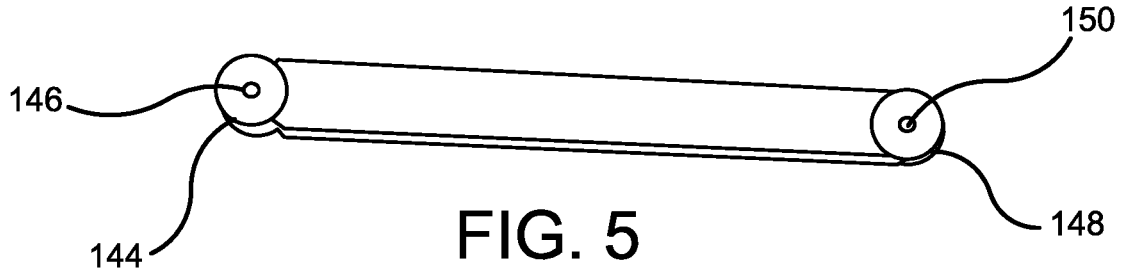
FIG. 5 illustrates an overhead view of one potential embodiment of a lifting lever of the toilet seat lifting and lowering apparatus of the present invention in accordance with the disclosed architecture.

The lifting lever 140 is pivotally attached to one end of the foot lever 120 and extends generally upward in line with the foot lever 120. As illustrated in FIGS. 4 and 5, the lifting lever 140 comprises a primary member 142. The primary member 142 comprises a proximal end 144 that terminates in a pivot connector 146. The pivot connector 146, may be a pin, rod, dowel, or similar rotatable element. The pivot connector 146 is configured to movably engage the bracket 134 of the arm 132 of the foot lever 120. The primary member 142 further comprises a distal end 148. The distal end 148 may comprise a pivot connector 150, similar to the pivot connector 146, for movably engaging the toilet seat attachment component 170.

Figure 9:
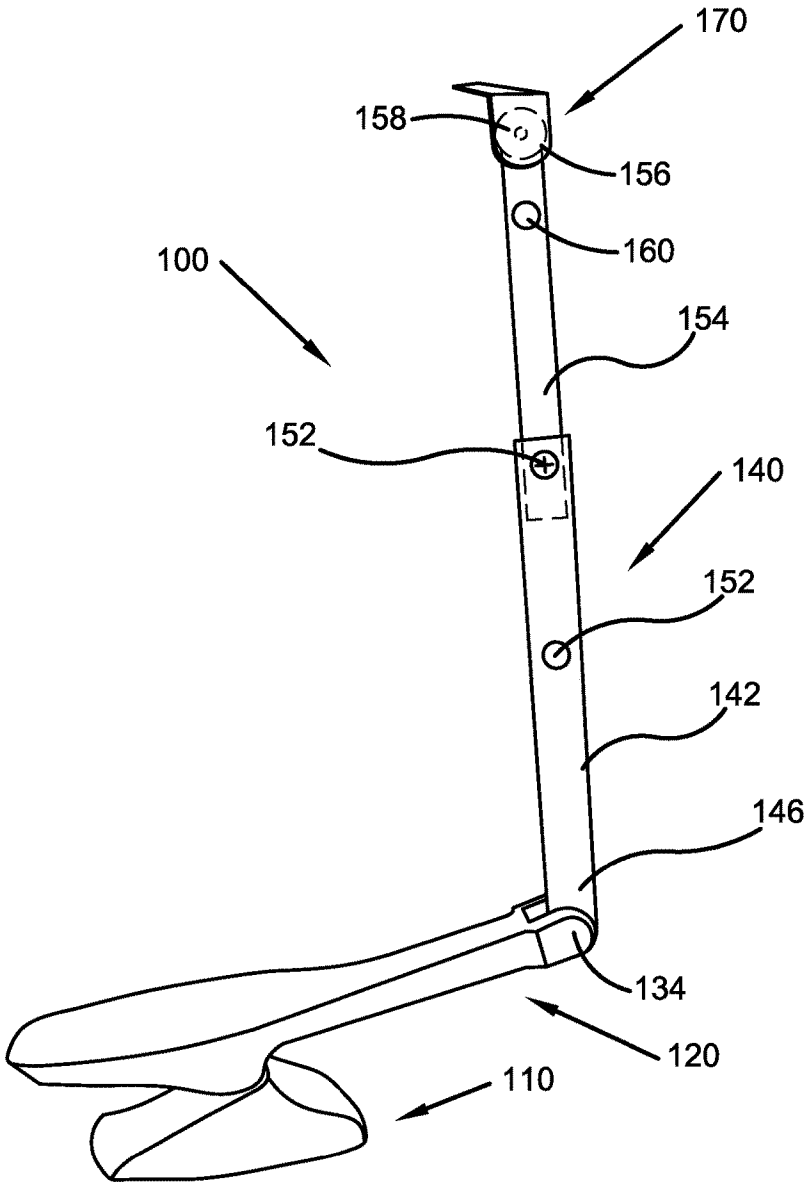
FIG. 9 illustrates a side perspective view of one potential embodiment of a lifting lever of the toilet seat lifting and lowering apparatus of the present invention in an extended configuration in accordance with the disclosed architecture.

As illustrated in FIGS. 3 and 9, the lifting lever 140 may be adjustable in length. The lifting lever 140 may further comprise an extension member 154. The extension member 154 telescopes out of the primary member 142 extending outward from the distal end 148 of the primary member 142. In this embodiment, the distal end 148 of the primary member 142 does not comprise the pivot connector 150.

Figure 7:
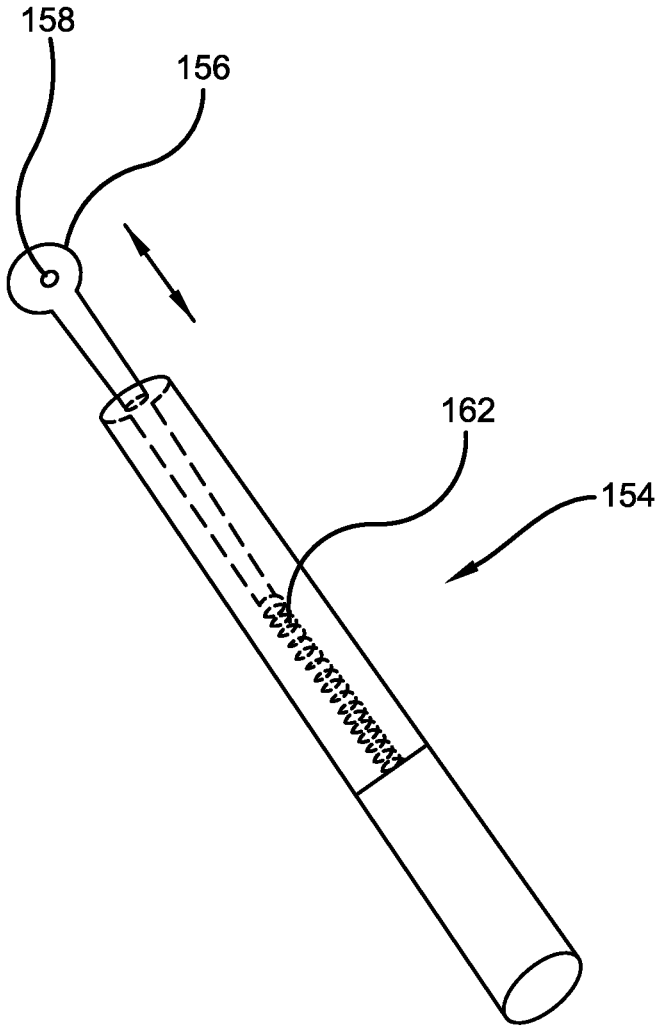
FIG. 7 illustrates a perspective view of one potential embodiment of a piston extension member of a lifting lever of the toilet seat lifting and lowering apparatus of the present invention in accordance with the disclosed architecture.
Figure 8:
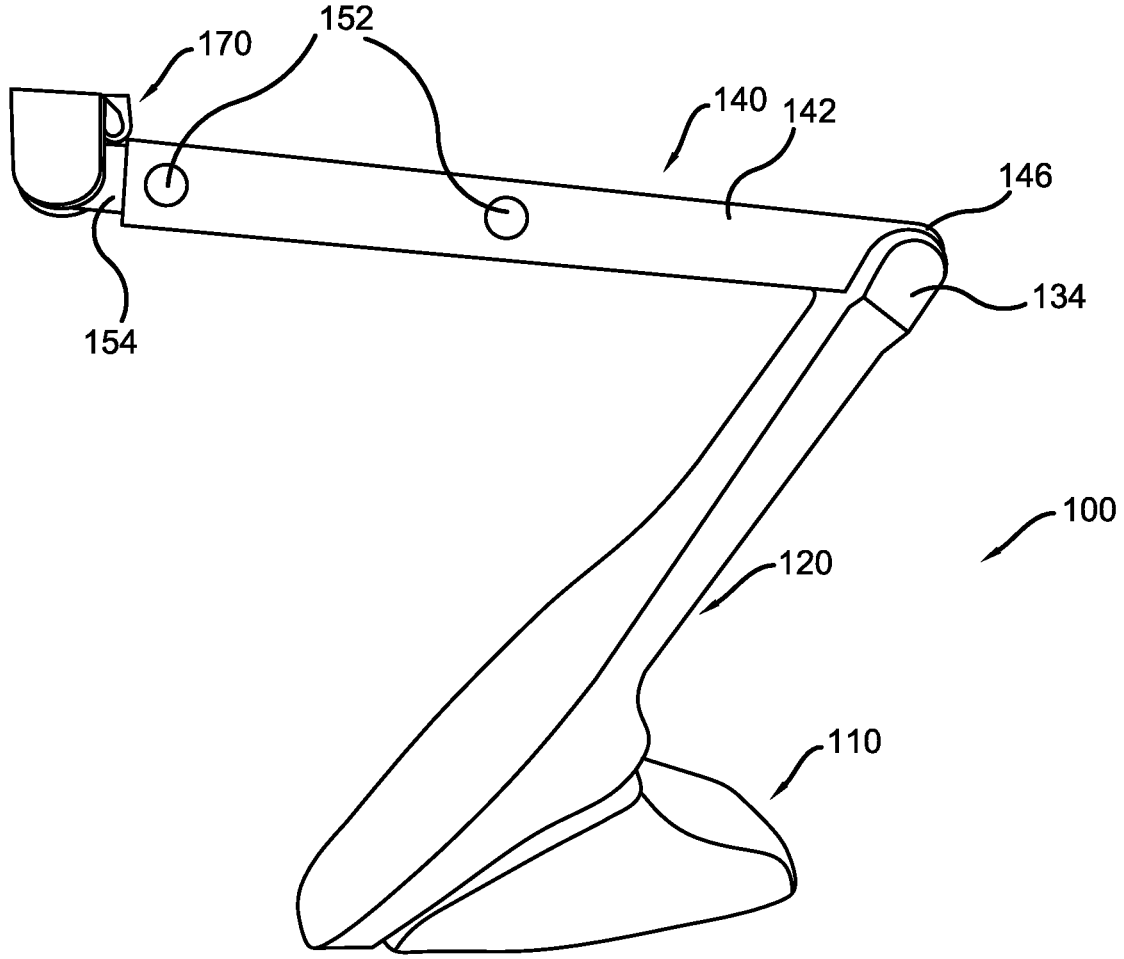
FIG. 8 illustrates a side perspective view of one potential embodiment of a lifting lever of the toilet seat lifting and lowering apparatus of the present invention in a seated configuration in accordance with the disclosed architecture.

The extension member 154 comprises a plurality of locking positions 160. As illustrated in FIGS. 8 and 9, the plurality of locking positions 160 are used to fix the lifting lever at different lengths to accommodate different toilet seat heights. The primary member 142 further comprises a plurality of locking positions 152 that mate with the plurality of locking positions 160 of the extension member 154 and are secured with mechanical fasteners. The extension member 154 further comprises a distal end 156. The distal end 156 of the extension member 154 comprises a pivot connector 158. The pivot connector 158 movably engages the toilet seat attachment component 170. The extension member 154 may be a spring piston 156 as illustrated in FIG. 7. This is advantageous as the toilet seat 10 will not accidently slam down if the user removes their foot from the foot pedal 128 too quickly.

The toilet seat attachment component 170 is pivotally attached to the lifting lever 140. The toilet seat attachment component 170 extends perpendicularly from the distal end 148 or 156 of either the primary member 142 or the extension member 154 of the lifting lever 140 depending on the configuration. The toilet seat attachment component 170 comprises a lifting lever connector 172 and a toilet seat bracket 180. The lifting lever connector 172 comprises a bracket 174 and an arm 176. The arm 176 extends laterally from the bracket 174 toward the toilet seat 12. The bracket 174 is configured to movably engage the pivot connector 150 or 158 of the distal end 148 or 156 of either the primary member 142 or the extension member 154 of the lifting lever 140. The arm 176 comprises a plurality of attachment holes 178.

Figure 10:
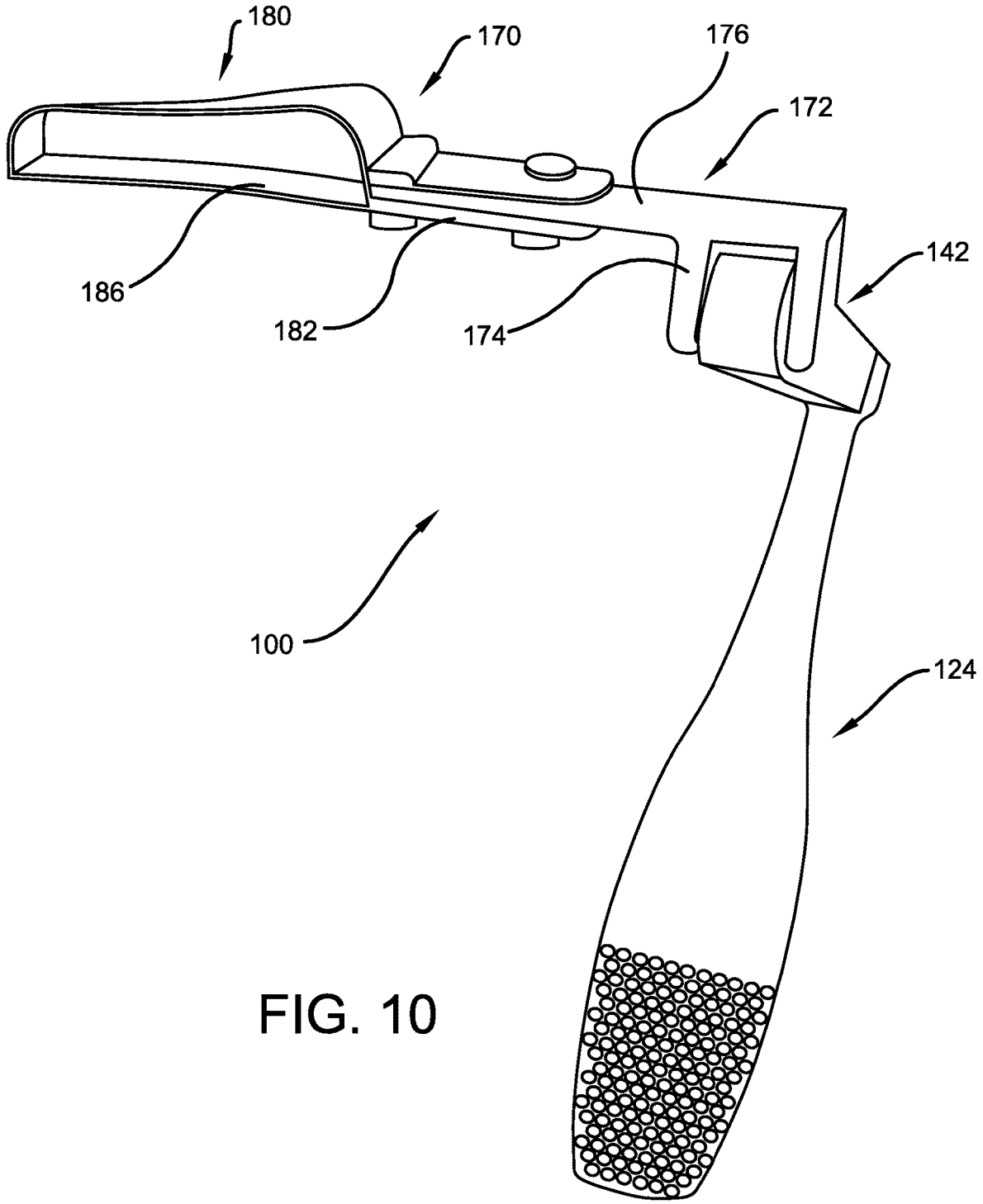
FIG. 10 illustrates an overhead perspective view of one potential embodiment of the toilet seat lifting and lowering apparatus of the present invention in accordance with the disclosed architecture.

As illustrated in FIGS. 3, 4, and 10, the toilet seat bracket 180 is attachable to the lifting lever connector 172. The toilet seat bracket 180 comprises a lifting lever attachment portion 182 and a seat engaging member 186. The lifting lever attachment portion 182 comprises a plurality of attachment holes 184 configured to mate with the plurality of attachment holes 178 of the arm 176 of the lifting lever connector 172. The lifting lever attachment portion 182 is then securable to the arm 176 of the lifting lever connector 172 with mechanical fasteners. The seat engaging member 186 is configured to engage the toilet seat 12. The seat engaging member 186 may directly secure to or encapsulate an adjacent portion of the toilet seat 12. The lifting lever attachment portion 182 opens to accept the toilet seat 12.

To use the toilet seat lifting and lowering apparatus 100, the user depresses the foot pedal 128 with a foot which lifts the arm 132 of the foot lever 120. The arm 132 pushes the lifting lever 140 upward which rotates the toilet seat attachment component 170 lifting the attached toilet seat 12. To lower the toilet seat 12, the user removes their foot from the foot pedal. This allows the arm 132 of the foot lever 120 to lower toward the floor and pulls the lifting lever 140 downward pulling the toilet seat attachment component 170 down to lower the toilet seat 12 without the need to physically touch the toilet 10.

Notwithstanding the forgoing, the toilet seat lifting and lowering apparatus 100 can be any suitable size, shape, and configuration as is known in the art without affecting the overall concept of the invention, provided that it accomplishes the above stated objectives. One of ordinary skill in the art will appreciate that the shape and size of the toilet seat lifting and lowering apparatus 100 and its various components, as show in the FIGS. are for illustrative purposes only, and that many other shapes and sizes of the toilet seat lifting and lowering apparatus 100 are well within the scope of the present disclosure. Although dimensions of the toilet seat lifting and lowering apparatus 100 and its components (i.e., length, width, and height) are important design parameters for good performance, the toilet seat lifting and lowering apparatus 100 and its various components may be any shape or size that ensures optimal performance during use and/or that suits user need and/or preference. As such, the toilet seat lifting and lowering apparatus 100 may be comprised of sizing/shaping that is appropriate and specific in regard to whatever the toilet seat lifting and lowering apparatus 100 is designed to be applied.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A toilet seat lifting and lowering apparatus comprising:

a base component comprising a plurality of mounting holes configured to accept a plurality of fasteners to mechanically attach the base component to a floor;

a foot lever pivotally attached to the base component;

a lifting lever pivotally attached to and extending upwardly from one end of the foot lever; and a toilet seat attachment component pivotally attached to and extending perpendicularly from a distal end of the lifting lever; and wherein the toilet seat attachment component comprises a lifting lever connector comprising a bracket movably engaging the lifting lever and an arm comprising a plurality of holes extending laterally from the bracket toward a toilet seat; and wherein the toilet seat attachment component further comprises a toilet seat bracket attachable to the lifting lever connector and comprising a seat engaging member and a lifting lever connector attachment portion comprising a plurality of holes configured to mate with the plurality of holes of the arm of the lifting lever connector and secure the lifting lever attachment portion to the arm; and wherein the seat engaging member is configured to completely surround and encapsulate an adjacent portion of the toilet seat.

2. The toilet seat lifting and lowering apparatus of claim 1, wherein the base component further comprises a receiving slot and the foot lever comprises a receiving slot engaging member that engages the receiving slot to form a hinge joint.

3. The toilet seat lifting and lowering apparatus of claim 1, wherein the foot lever comprises a foot pedal and an arm extending out of the foot pedal terminating in a bracket.

4. The toilet seat lifting and lowering apparatus of claim 3, wherein the lifting lever comprises a pivot connector on a proximal end of the lifting lever for engaging the bracket of the arm of the foot lever.

5. The toilet seat lifting and lowering apparatus of claim 1, wherein the lifting lever comprises a pivot connector on a distal end of the lifting lever for engaging the toilet seat attachment component.

6. A toilet seat lifting and lowering apparatus comprising:

a base component mountable to a floor, the base component comprising a receiving slot;

a foot lever comprising a receiving slot engaging member on a bottom side of the foot lever for pivotally engaging the receiving slot of the base component;

a lifting lever comprising a primary member pivotally attached to and extending upwardly from one end of the foot lever, and an extension member extending from the primary member; and a toilet seat attachment component pivotally attached to and extending perpendicularly from a distal end of the extension member of the lifting lever; and wherein the extension member of the lifting lever is a spring piston; and wherein the toilet seat attachment component comprises a lifting lever connector comprising a bracket movably engaging the lifting lever and an arm comprising a plurality of holes extending laterally from the bracket toward a toilet seat; and wherein the toilet seat attachment component further comprises a toilet seat bracket attachable to the lifting lever connector and comprising a seat engaging member and a lifting lever connector attachment portion comprising a plurality of holes configured to mate with the plurality of holes of the arm of the lifting lever connector and secure the lifting lever attachment portion to the arm; and wherein the seat engaging member is configured to completely surround and encapsulate an adjacent portion of the toilet seat.

* * * * *